US005292011A

United States Patent [19]

Kostigian

[11] Patent Number: 5,292,011

[45] Date of Patent: Mar. 8, 1994

[54] CARPET DISPLAY RACK

[76] Inventor: John Kostigian, 39 Elgin St. S., Cambridge, Ontario, Canada, N1R 5G3

[21] Appl. No.: 918,044

[22] Filed: Jul. 24, 1992

[51] Int. Cl.[5] ..... A47F 7/16

[52] U.S. Cl. ..... 211/48; 211/98; 211/103

[58] Field of Search ..... 211/48, 47, 96, 102, 211/98, 103

[56] References Cited

U.S. PATENT DOCUMENTS

| | | | |
|---|---|---|---|
| 806,705 | 12/1905 | O'Neal | 211/47 |
| 1,006,834 | 10/1911 | Edwards | 211/47 |
| 1,099,345 | 6/1914 | Dougherty | 211/48 |
| 1,162,989 | 12/1915 | Doran | 211/47 |
| 1,745,713 | 2/1930 | Reed | 211/48 |
| 2,023,866 | 12/1930 | Best | 211/48 |
| 3,315,813 | 4/1967 | Schneider | 211/47 |

*Primary Examiner*—Paula A. Bradley
*Assistant Examiner*—Chuck Y. Mah
*Attorney, Agent, or Firm*—Robert G. Hendry; Robert A. Wilkes

[57] ABSTRACT

A rack for hanging room sized carpets in show rooms. The rack has a plurality of uprights, each of which has a horizontal arm including a brace capable of supporting a hanging carpet. The arm is adapted to be raised and lowered by a cable entrained on pulleys and moved by a worm drive type winch operated by a portable drive means such as an electric drill. The cable and winch are mounted in the channel of each upright.

5 Claims, 2 Drawing Sheets

CARPET DISPLAY RACK

This invention relates to display racks and more particularly to a display rack for hanging room sized carpets.

When oriental carpets are piled on showroom floors, customers will request that a carpet in the middle of the stack be removed for closer examination. It is therefore desirable to have carpets hanging in such a manner in order that a number of carpets can be viewed without moving a number of carpets as this requires a great deal of labour.

However, raising the carpets to a hanging position can not be done conveniently without proper equipment and furthermore, customers may request that the hanging carpet be spread horizontally. It is desirable therefore, that a sales person be able to conveniently raise and lower any carpet with a minimum of effort.

Attempts to provide display racks of this type include U.S. Pat. No. 2,000,336 which discloses a horizontal carpet support raised by pulling a rope. Other prior attempts include those disclosed in U.S. Pat. Nos. 3,187,900, W. Schneider; and 3,330,418, W. Schneider.

It is considered desirable therefore, to provide a display rack which will be capable of being motor driven to minimize the physical effort required of the sales person to raise and lower carpets. A further consideration is to provide maximum safety.

A still further consideration is that of minimizing damage to expensive carpets by exposed moving parts such as cables.

Accordingly, the present invention provides a display rack secured in an upright position for hanging carpets. The rack comprises an upright hollow support member, an arm assembly including a horizontal member, and a diagonal brace for movement from a lowered position to an upper storage position. The horizontal member has an upper support roller bearing on a side of the upright support; a lower support roller on an end of the diagonal brace bearing on a side of the support opposite from the upper support roller; a pulley adjacent an upper end of the upright support; and a worm drive winch on the upright tubular member whereby a flexible tension member wound on the winch extends over the pulley on the upper end of the support and has a free end secured to the arm assembly.

Another embodiment of the invention comprises an upright tubular support member, an arm assembly including a horizontal member, and a diagonal brace for movement from a lowered position to an upper storage position. The horizontal member has an upper support roller bearing on a side of the upright support; a lower support roller on an end of the diagonal brace bearing on a side of the support opposite from the upper support roller; a first pulley adjacent an upper end of the upright support; a pair of top pulleys on the support; a bottom pulley on the arm assembly adjacent the support; and a winch on the upright tubular member whereby a flexible tension member wound on the winch extends over the first pulley on the upper end of the support. Over one of the top pulleys, entrains said bottom pulley, the other top pulley, and has a free end secured adjacent the bottom pulley.

In the drawings which illustrate an embodiments of this invention:

Figure 1:
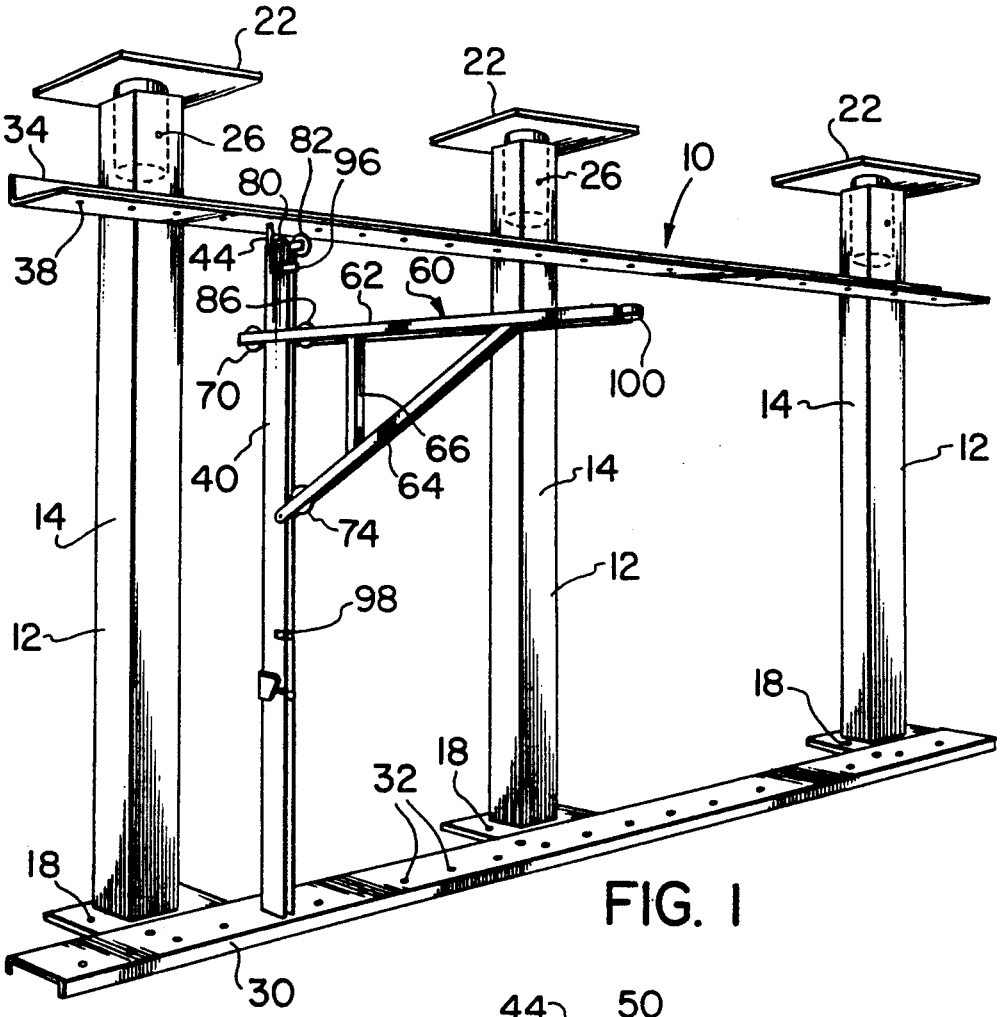
FIG. 1 is an exploded perspective view of the display rack of this invention.

Referring now in detail to the drawings in which the numeral 10 generally denotes a carpet display rack, the rack 10 has a supporting assembly 12 including posts 14 having bottom plates 18. The posts 14 are also provided with adjustable top plates 22 secured in the adjusted position by set screws 26.

A lower channel plate 30 has spaced apart apertures 32 and a top plate 34 of right angle cross section which has apertures 38 vertically aligned with the apertures 32 of the lower plate 30. Vertical support members 40 of C shaped cross section (one of which is shown) have upper and lower pins 44 and 46 adapted to be received in the apertures 34 and 32 respectively for pivotal movement. The pin 44 carries a slidable collar 50 adjustable by means of set screw 52. It will be noted that the upright member 40 has a channel 54 as shown more clearly in FIG. 2.

An arm assembly 60 adapted to move vertically on the upright channel member 40, includes a horizontal member 62, a diagonal brace 64, and a vertical brace 66 extending there between. An associated end of the arm 60 is bifurcated to receive the upright tubular member 40, and a roller 70 mounted at the end of the horizontal member 60 engages the other side of the tubular member 40. The lower end of the brace 64 is also bifurcated to receive a roller 74 bearing against the adjacent side of the tubular member 40.

Figure 2:
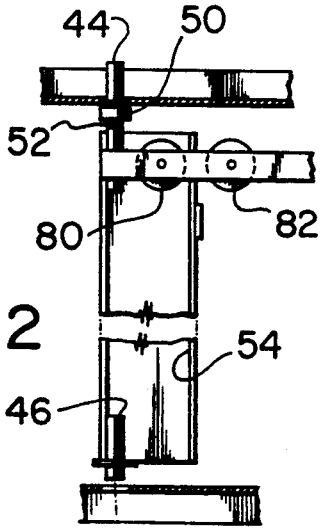
FIG. 2 is a side elevational view of the invention of FIG. 1.

As shown more clearly in FIG. 2, a pulley 80 is mounted for rotation in a conventional manner in the channel 54. Two additional pulleys, 82 and 84 are mounted on the outside of the tubular upright 40 adjacent the pulley 80. A fourth pulley 86 is mounted on the horizontal member 62 adjacent the upright member 40.

Figure 3:
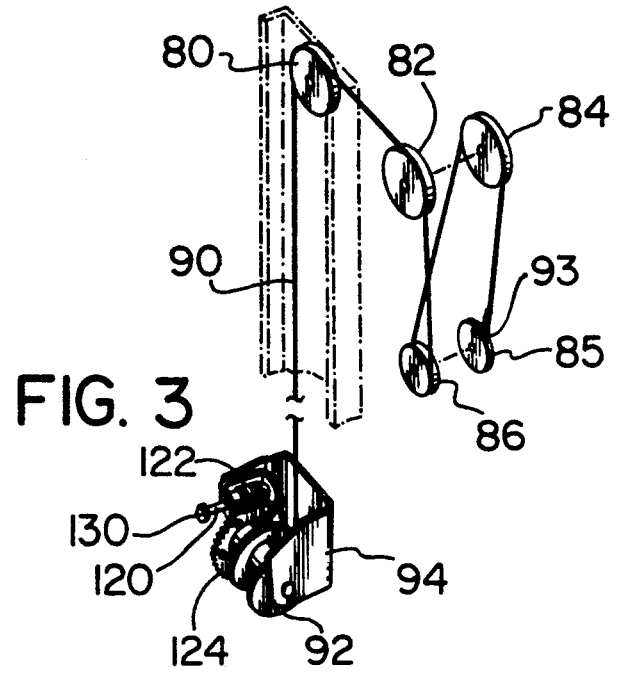
FIG. 3 is a diagrammatic view of the cable and pulley of this invention.

As illustrated in FIG. 3, a cable 90 wound on a drum 92 of a winch 94 entrains the pulley 80, a top pulley 82, the pulley 86 on the arm, then extends over the other pulley 84 at the top of the member 40, and has its end 93 looped over fastening means 85 adjacent the pulley 86.

Figure 4:
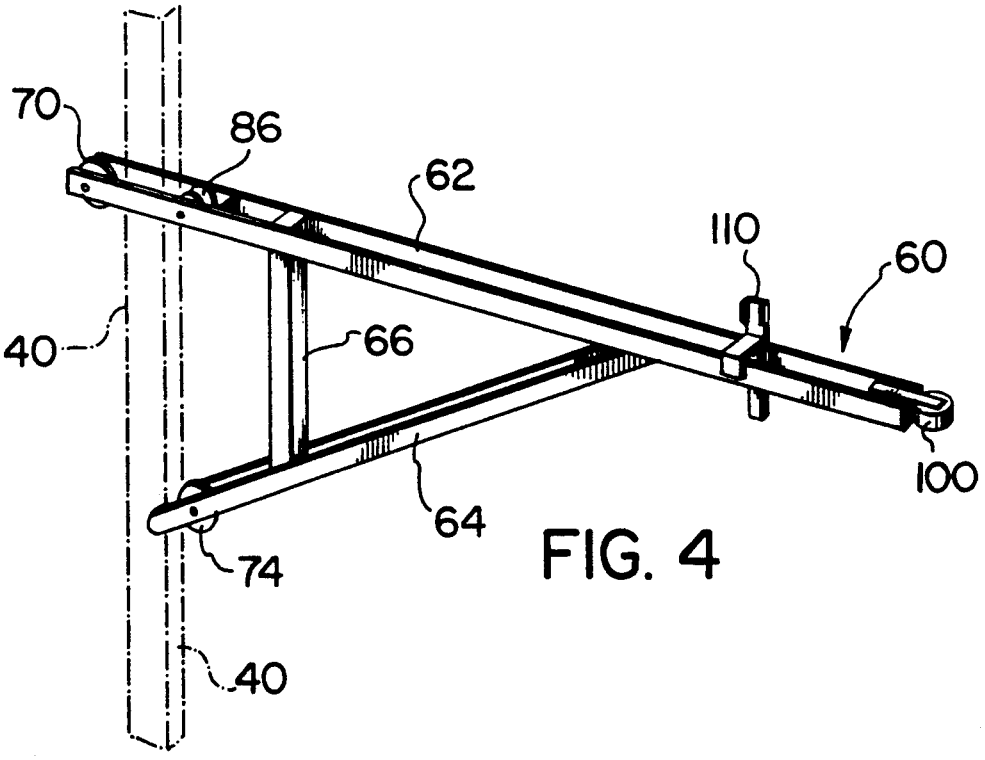
FIG. 4 is an exploded perspective of an arm assembly.

Other features include a stop plate 96 on the upright 40 to limit upward travel of the arm 60 and a stop plate 98 to prevent jamming of the cable 90 as the arm assembly 60 is lowered. A nylon roller 100 is provided on the outer end of each arm assembly 60, although means for attaching a carpet (not shown) to the horizontal member 62 does not form part of this invention, a carpet clip 110, as shown in FIG. 4, grips an upper edge of the carpet. The clip 110 is the subject of another patent application by this inventor.

The winch 94 is of the type referred to as worm gear shaft and meshes with a gear 124 for rotating the winch drum 92. A hexagonal nut 130 is secured to the shaft 120 in a conventional manner as by welding to facilitate turning the shaft through the use of portable drive means such as an electric drill. A suitable winch manufactured by the Fulton Manufacturing Corp. of Milwaukee, Wis., U.S.A. has a capacity of 1500–2000 lbs. and a gear ratio of 31.1. The worm gear winch is self-braking so that the winch drum cannot accidentally run free.

In use the arm assembly 60 can be raised and lowered, the cable 90 having been correctly installed on pulleys 80, 82, 84 and 86, and wound on the winch drum 92. The carpet (not shown) is then secured to the arm assembly 60 through the use of clips 110 and the arm assembly is raised by using an electric drill to wind cable 90 on the winch drum 92. It will be appreciated that if the operator stops the power unit for any reason before fully raising or lowering the arm assembly 60, the winch cannot run free due to the provision of the self-braking winch 94.

I claim:

1. A display rack secured in an upright position for hanging carpets, the rack comprising;

at least one upright hollow support member, an arm assembly carried by the support member, the arm assembly including a horizontal member and a brace, an upper support roller on the horizontal member bearing on a side of the upright support, a lower support roller on an end of the brace bearing on a side of the upright support opposite from the upper support roller, a first pulley on an upper end of the upright support, a pair of top pulleys adjacent the support, a bottom pulley on the arm assembly adjacent the support, and a winch on the hollow support member whereby a flexible tension member wound on the winch extends over the first pulley, over one of the top pulleys, entrains the bottom pulley, the other top pulley, and has a free end secured adjacent the bottom pulley for moving the arm assembly from a lowered position to an upper carpet display position.

2. A display rack as claimed in claim 1 wherein the winch has a worm gear drive having a gear ratio which resists unwinding of the cable.

3. A display rack as claimed in claim 2 wherein one or more of the upright support members are supported on upper and lower plate members having apertures to receive pins whereby a pin on an upper end of the upright support is received in an aperture in the upper plate, and a pin on the lower end of the upright support member is received in an aperture in a lower plate member for pivotally supporting the upright support members.

4. A display rack secured in an upright position for hanging carpets, the rack comprising;

an upright hollow support member, an arm assembly including a horizontal member bifurcated so as to be received on the upright member, a diagonal brace on the horizontal member, an upper support roller on the end of the horizontal member bearing on a side of the upright support, a lower support roller on an end of the brace bearing on a side of the upright support opposite from the upper support roller, a first pulley on an upper end of the upright support, a pair of top pulleys adjacent the support, a bottom pulley on the brace adjacent the support, and a winch in the hollow support member whereby a flexible tension member wound on the winch extends over the first pulley, over one of the top pulleys, entrains the bottom pulley, the other top pulley, and has a free end secured to the arm assembly adjacent the bottom pulley for moving the arm assembly from a lowered position to an upper carpet display position.

5. A display rack secured in an upright position for hanging carpets, the rack comprising;

an upright hollow support member of C shaped cross section, an arm assembly including a horizontal member, a diagonal brace on the horizontal member, an upper support roller on the horizontal member bearing on a side of the upright support, a lower support roller on an end of the brace bearing on a side of the upright support opposite from the upper support roller, a first pulley on an upper end of the upright support, a pair of top pulleys adjacent the support, a bottom pulley on the brace adjacent the support, and a winch in the hollow support member whereby a flexible tension member wound on the winch extends through the upright hollow support, over the first pulley, over one of the top pulleys, entrains the bottom pulley, the other top pulley, and has a free end secured adjacent the bottom pulley for moving the arm assembly from a lowered position to an upper carpet display position.

* * * * *